US007569799B2

(12) United States Patent
Gunther et al.

(10) Patent No.: US 7,569,799 B2
(45) Date of Patent: Aug. 4, 2009

(54) COMPOUND BODY AND METHOD FOR MANUFACTURING IT

(75) Inventors: Herbert Gunther, Allendorf (DE); Christel Kretschmar, Borthen (DE); Uwe Partsch, Dresden (DE); Peter Otschik, Possendorf (DE)

(73) Assignee: Gunther GmbH & Co., Metallverarbeitung, Frankenberg/Eder (DE)

( * ) Notice: Subject to any disclaimer, the term of this patent is extended or adjusted under 35 U.S.C. 154(b) by 578 days.

(21) Appl. No.: 10/531,185

(22) PCT Filed: Oct. 13, 2003

(86) PCT No.: PCT/EP03/11318

§ 371 (c)(1),
(2), (4) Date: Oct. 21, 2005

(87) PCT Pub. No.: WO2004/036956

PCT Pub. Date: Apr. 29, 2004

(65) Prior Publication Data

US 2006/0165901 A1 Jul. 27, 2006

(30) Foreign Application Priority Data

Oct. 11, 2002 (DE) ..... 102 47 618

(51) Int. Cl.
*H05B 3/58* (2006.01)
*B05D 3/02* (2006.01)

(52) U.S. Cl. ..... 219/535; 219/424; 219/420; 219/426; 219/422; 219/534; 219/543; 219/552; 219/553; 427/318; 428/457

(58) Field of Classification Search ..... 219/535, 219/424, 420, 426, 422, 534, 543, 552, 553; 427/318; 428/457
See application file for complete search history.

(56) References Cited

U.S. PATENT DOCUMENTS

| | | | |
|---|---|---|---|
| 4,713,530 | A | 12/1987 | Schittenhelm et al. |
| 5,312,241 | A | 5/1994 | Gunther |
| 5,973,296 | A | 10/1999 | Juliano et al. |
| 6,069,910 | A | 5/2000 | Eckert |

FOREIGN PATENT DOCUMENTS

| | | | |
|---|---|---|---|
| DE | 35 36 268 | | 4/1987 |
| DE | 35 45 445 | | 6/1987 |
| DE | 199 41 038 | | 3/2001 |
| DE | 100 04 072 | | 7/2002 |
| DE | 199 08 936 | | 10/2002 |
| JP | 9-94911 | * | 4/1997 |
| WO | WO 00/23245 | | 4/2000 |

* cited by examiner

*Primary Examiner*—Shawntina Fuqua
(74) *Attorney, Agent, or Firm*—Clark & Brody

(57) ABSTRACT

A compound body comprises a steel base element on which is deposited a heater layer. The base element is made of a precipitation hardening steel. In the form of a manifold or material feed tube in a hot duct system, said base element comprises a round or convex surface receiving the heater layer. This heater layer is a compound layer having several strata and/or strata elements which are thick film pastes or sheets and in such form are consecutively deposited, dried and baked-on. The pre-compression generated in this process in the heater layer is increased in controlled manner by precipitation hardening the base element.

36 Claims, No Drawings

COMPOUND BODY AND METHOD FOR MANUFACTURING IT

FIELD OF THE INVENTION

The present invention relates to compound bodies comprising a steel base element on which is mounted a heater layer as defined in the preamble of claim 1, furthermore it relates to a method as defined in the preamble of claim 17 for manufacturing said compound body.

BACKGROUND OF THE INVENTION

Heating devices have been developed in thick film engineering for various applications and, in the form of coatings, are firmly bonded on the surface of a metal substrate or a steel element. In general the heating devices are constituted by electrical resistance paths and are electrically insulated from the metal substrate, i.e. metal element, by a dielectric insulating layer or by glass ceramics. Following their deposition, all strata are baked into a stratified layer which together with the steel element constitutes a compound body. Such designs are illustratively known from the German patent documents 35 36 268 A1 and 35 45 445 A1.

Problems inevitably arise if the steel element comprises a round or convex surface and must be hardened where for instance hot duct systems in injection molds are involved. As a rule said injection molds are fitted with a branched grid of feed ducts and hot duct nozzles having steel tubes which in certain applications are exposed to extremely high inner pressures. In order that the hot material in the feed or manifold system shall not cool prematurely, the said tubes are fitted peripherally with heating elements.

The PCT patent document WO 00 23 245 A1 proposes in this respect to configure the heating system in the so-called Fine Film Printing procedure wherein the individual layers are deposited using a dispenser. Such a procedure is comparatively elaborate and costly because the dispenser of the hollow dispensing needle must move in precise manner along the full surface of the ceramic, material-feed tube when depositing the insulating layer and top coat in order to make layers closed per se. As a result said layers are not always uniformly thick and/or dense, and crack formation can hardly be avoided.

Operation of the hot duct system raises another drawback: the material material feed tube is subjected at operating temperature to the pulsating internal pressure technically entailed by injection molding. Said loads applied to and heating the flow duct wall required for operating temperatures between 300 and 450° C. cause elastic expansions which are directly transmitted to the heating elements. The strata of the heating elements may rapidly enter the zone of tensile stresses, the consequences then possibly being cracks in the insulating layer, electrical shorts or even spalling of the entire heating device.

To remedy such difficulties, the heater layer already has been deposited on an accessory steel element which then is mounted on the material feed tube. Such separated heating however is devoid of any direct physical contact with the material feed tube and therefore must overcome a high thermal transfer impedance, hence incurring low heat transfer efficiency from heater elements to the tubular flow duct. This trait affects in turn the overall temperature control and the consequent cost of regulation.

The German patent document 199 41 038 A1 discloses directly depositing the heating layer on the material feed tube and to design said layer in a manner that, following baking (forming), it shall be subjected at a defined pre-compression relative to the said feed tube's wall. As a result and as a function of the elongation characteristics of the hot duct tube, a specific mismatch between the linear expansion coefficient of the glass ceramics insulating layer and the corresponding value of the metallic hot duct tube is predetermined. Such a stress tolerant connection withstands within certain limits the elastic elongations of the material feed tube. However, as regards high loads, cracks or other damages still may arise in the insulating layer.

DESCRIPTION OF THE INVENTION

It is the objective of the present invention to overcome the above and other drawbacks of the state of the art and to fit a steel element with a heater layer which shall withstand even long-term, extreme loads. In particular the object of the present invention is to create an economical and easily implemented method to deposit crack-free strata exposed to the various temperature changes onto a tubular or convex steel element. In particular a heater layer configured on a material feed tube of hot duct nozzle shall remain permanently operable.

The main features of the invention are listed in claims 1 and 17. Embodiment modes of the invention are the objects of claims 2 through 15 and 18 through 28. Claim 16 defines a preferred application.

The problem basic to the invention is solved by providing a composite body having a steel base element onto which is mounted a deposited heater layer, said base element being made of a precipitation hardened steel.

Precipitation hardened steels offer the feature that intermetallic precipitates form during cooling and that they entail—besides the volumetric reduction merely caused by the drop in temperature—a further reduction of the volume of said steel element. Therefore a precipitation hardened steel will shrink during the age hardening process and consequently the precompression of a heater layer previously deposited on a base element surface will be magnified following hardening. The layer is always and permanently firmly joined to the steel element surface even when the compound body is exposed to high temperature and compressive loads.

By using high-alloy steels, the magnitude and the distribution of the precompression within the insulating layer may be adjusted in especially accurate and precise manner, this feature being foremost significant when the steel element exhibits a round or convex surface receiving the insulating layer or when the steel element assumes a tubular geometry and the heater layer must be deposited on the outer wall.

The base element offers special advantages by being a manifold or a material feed tube of a hot duct system. It is especially important in the field of hot ducts that the injection molding material being fed to a molding nest is precisely and uniformly temperature controlled as far as into the zone of the nozzles, i.e. the feed orifices. Cracks in the heater layer would immediately entail nozzle failure and interruption of manufacture: this eventuality is effectively precluded by the composite body design of the invention.

Preferably the heater layer consists of a composite layer built up of several strata and/or stratum elements and comprising an insulating layer deposited on the base element. The base element is a ceramic or glass-ceramic insulating layer which, depending on the deposition procedure and desired layer thickness, may consist of two or more individual strata. A configuration of resistance elements is deposited on said insulating layer.

Advantageously as regards manufacture, the insulating layer, furthermore the resistance elements and/or the top coat are baked dispersions, for instance thick film pastes. Said pastes may be deposited uniformly and in finely controlled manner to positively affect subsequent adhesion and heating operability. Alternatively the individual strata or partial strata of the heater layer may be baked-on foils.

In another embodiment, at least one temperature sensor is configured in the plane of the heater layer in order to ascertain both the temperature distribution and its genesis within the heater, i.e. inside the base element. Accordingly said temperature sensor is configured within the compound stratum without entailing sensible increase in volume. At the same time temperature changes may be detected practically at the time they take place and in very accurate manner.

Hookup terminals for the resistance elements and/or the temperature sensors are integrated into the heater layer. In this manner the heater as a whole may be directly integrated into a control circuit.

Further important advantages are attained using a compound body of the invention when said compound body is configured in a hot duct manifold and/or a hot duct nozzle. The stratified deposition of the heater assures a firm and permanent connection to the base element wall and hence secures firm adhesion to the hot duct manifold or the hot duct nozzle. Moreover the invention most effectively precludes spalling or detachment of the heater in that the precompression in the heater layer is raised in controlled manner by precipitation hardening.

Because direct coating achieves thinness, the heater layer is very compact and as a result, compared to conventional heating designs and at nearly identical performance, very compact designs are made possible by the present invention. Furthermore power density may be substantially increased because the heat is generated directly at the surface of the hot duct element to be heated and can be directly dissipated from it. The usually sensitive heater elements are therefore reliably precluded from overheating.

As regards a method for manufacturing a compound body comprising a steel base element on which is deposited a heater layer, the invention provides therein reinforcement of a pre-existing precompression in the heater element by precipitation hardening the base element.

Said method of the invention is both simple and economical and results in a firm, permanent connection between the base element and the heater layer because said heater layer is shrunk further within defined limits by the displacement of contraction of the base element due to cooling while hardening, as a result of which a highly stress-tolerant connection is produced. All heater strata or partial strata exhibit extraordinarily good adhesion. In particular the insulating layer permanently withstands even extreme mechanical and thermal loads, and consequently optimal products are always attained.

Each stratum or stratum element of the heater layer is deposited on the base element, dried and baked/formed, and following each baking, the compound body is cooled to room temperature. In this manner all method parameters may be individually matched to the particular heater layer that, depending on the required power, may thus be optimally deposited.

Moreover, the invention calls for homogenizing, i.e. solution annealing the steel alloy of the base element during baking, such a procedure being especially advantageous regarding the method economy. A contribution to this advantageous feature is made by providing the baking temperature be the same as the homogenizing, i.e. solution annealing temperature of the base element. As the individual strata or layer elements of the heater layer are being formed, stable mixed crystals ($\alpha$ crystals) are produced by means of said solution annealing. Therefore separately controlled manufacturing stages are no longer required.

In another embodiment, the individual strata may be deposited using screen printing, dispensers, by immersion or spraying. Therefore the optimal procedure may be selected at each method step. All stratum parameters such as stratum thickness, density, shape and the like may be adjusted uniformly and accurately, always attaining thereby a functional heater layer.

Each stratum or stratum element can be baked or formed in an atmospheric ambience, the baking temperature being between 750 and 900° C.

The base element's surface can be roughened. e.g., sand blasting before the heater layer is deposited. Such a feature improves the mechanical adhesion of the insulation layer. Chemical adhesion may be optimized by cleaning and oxidizing the base element before coating.

After the heater layer has been deposited, the steel alloy of the base element is aged, i.e age hardened by renewed annealing. Fine intermetallic precipitates are formed allowing a targeted reduction of base element volume. In this process compressive stress is generated within the heater layer deposited on the base element making it possible to permanently balance mechanical loads applied to the base element, for instance the inner pressure loads on a material feed tube of a hot duct nozzle.

Another important aspect of the invention is that that the age hardening temperature can be less than the baking temperature of the individual strata of the heater layer. As a result, neither forming the individual strata, i.e. of the heater layer, nor its cohesion, shall be interfered with. Furthermore the precompression in the heater layer is optimally increased without its performance parameters or functionality being degraded. The overall procedure may be controlled using simple means and therefore the costs of the method remain low.

Appropriately the age hardening procedure is carried out in air or under a nitrogen atmosphere.

Further features, particulars and advantages of the present invention follow from the wording of the claims as well as being elucidated in the description below of illustrative embodiments of said invention.

In one preferred embodiment mode of the invention, the initial material used in making the base element is a precipitation hardening steel, highly alloyed with Ni, Co, Mo, Ti and/or Al, for instance X 3 Cr Ni Al Mo 12 9 2 1. Illustratively the base element constitutes a material feed tube having a cylindrical surface for an externally heated hot duct nozzle used in an injection mold.

A heater layer is deposited on the base element. This heater layer consists of an insulating glass-ceramic stratum directly resting on the base element, furthermore of a configuration of resistance paths mounted on said insulating stratum and acting as a heating element, and thereabove a top coat to protect the heater layer against external factors. The heater layer and the base element are connected to each other in undetachable manner and thereby constitute a compound body.

Typically the precipitation hardening of the material feed tube takes place in two stages, namely solution annealing the alloy and subsequent aging, i.e age hardening.

However, before the above is carried out, the individual strata or stratum elements of the heater layer are deposited in the form of thick film pastes and are baked, i.e. formed, solution annealing of the metal alloy being carried out simultaneously with baking the thick film pastes.

Also, at the beginning of the method of the invention, the still unhardened steel element will be sand-blasted once it has been mechanically processed in order to improve the adhesion relating to the heater layer, a specified surface roughness being required. Thereupon the material feed tube is cleaned with ethanol and warm nitric acid (HNO3) and oxidized at about 850° C. As a result a thin oxide film is created on the base element's surface and does improve the insulating layer's adhesion.

Upon completion of pre-treatment, the heater layer is manufactured.

Preferably the insulation layer's initial material is a dispersion, in particular an electrically insulating thin film which is screen printed at uniform thickness on the base element surface. Preferably four individual strata are deposited consecutively, each stratum being dried separately. Once the desired layer thickness has been attained, the material feed tube together with the insulating layer shall be formed in an appropriate baking oven under atmospheric air at about 850° C., as a result of which a homogeneous glass-ceramic structure has been constituted.

In this procedure the baking temperature corresponds to that required to homogenize or solution anneal the base element. Both procedures—baking and solution annealing—therefore take place simultaneously.

On account of a specified mismatch between the linear thermal coefficient of expansion of the insulating layer and the linear thermal coefficient of expansion of the material feed tube, a mechanical precompression is generated in the insulation layer while it is being baked. The resulting stress-tolerant connection in the compound body already enables the insulation layer serving as support for the heater layer to withstand within certain limits the pulsating inner pressure loads in the material feed tube that are technically entailed by the injection molding procedure without cracks in or damages to the heater layer taking place.

After the base element together with the baked insulating layer has cooled to room temperature, first the electric terminals for the conducting resistance elements, and as called for, for a temperature sensor, are being mounted and dried. Starting at the electric terminals the mostly meandering or spiral resistance paths for the heater and also for the temperature sensor are deposited, using for this purpose—as well as for the electric terminals—electrically conducting pastes which are deposited, either by screen printing or using a dispenser, onto the insulating layer. Drying is always carried out after the individual strata have been deposited. All conductive layer elements thereupon are baked jointly and cooled to room temperature. In this process too the base element again is solution annealed, though this step as yet does not permanently affect its structure.

The top coat also is an electrically insulating glass-ceramic which is screen printed on the resistance elements, on the electrical terminals and on the still freely exposed insulation layer in the partial zones, and then dried and thereafter being formed at approximately 750 to 900° C.

Following the last baking procedure, the base element together with the already deposited heater layer shall be heated again under a nitrogen atmosphere to about 525° C. and then is kept at this temperature for a defined time interval. Upon expiration of said interval, the compound body is cooled preferably at a cooling rate of −10° K/min.

The precipitation hardened steel shrinks during hardening at 525° C. by about 0.07% in all directions and when cooled again by about 11 ppm/° K, as a result of which the previously deposited and formed strata of the heater layer are compressed further. Accordingly precipitation hardening entails additional precompression and consequently the entire heater layer is able to permanently withstand even extreme temperature and inner pressure loads in the material feed tube. The hot duct nozzle is always optimally temperature controlled by means of the intimately bonded heater layer at every stage of the method of the invention.

The base element hardness attained after the hardening process is about 52 HRC.

Preferably the temperature sensor is situated in the same plane as the resistance paths of the heater. This sensor is integrated, as are the electrical terminals, into the heater layer. Said heater layer constitutes a compound layer, composed of several strata or stratum elements, which is undetachably joined to the base element and thus forms with latter a heated compound body.

In view of its high temperature coefficient of resistance TCR, the heater resistance itself may be used as a temperature sensor. For that purposes voltage taps from desired zones of the meandering or spiral resistance paths may be accessible from the outside. If the current is known, the detected partial voltage may indicate the temperature in such zones.

The present invention is not restricted to one of the above described embodiment modes, but instead it may be varied in many ways. For instance particular or all strata or layer elements of the heater layer also may be deposited by spraying or immersion. Alternatively sheets also may be used that shall be baked in the same manner as are the thick film pastes.

Also, the steel alloy of the base element may be a nickel-cobalt hot work steel. Appropriately and with respect to the baking or sintering of the heater layer, the steel must be suitable for peak temperatures up to 850 to 900° C. Furthermore this steel must be able to withstand operational temperatures up to 450° C. as well as internal pressure loads up to 2,000 bars.

It is understood that precipitation hardening steels may be used as the initial material for the steel element. Contrary to the case of the conventional hardening by means of carbon martensite, the above steels experience intermetallic precipitations that can be accurately controlled by means of alloy selection. The contraction taking place during hardening increases the compression stress in the insulating layer or in the entire heater layer and as a result substantially improves both service life and functional reliability.

Such features are beyond the reach of conventionally hardening steels unless the steel element be cooled at a critical rate. However the entailed high temperature and the high rate of cooling would destroy the heater layer: this eventuality is averted in simple and economical manner by the present invention.

All features and advantages following from the above discussion, inclusive design details, spatial configurations and method steps may be modified within the scope of the present invention also in any conceivable combinations.

The invention claimed is:

1. A compound body comprising a steel base element on which is deposited a heater layer, characterized in that the base element is made of a precipitation hardening steel, characterized in that the heater layer is a compound layer consisting of several strata and/or stratum elements and that the heater layer comprises an insulation layer that is a ceramic or glass ceramic and consists of at least two individual strata.

2. Compound body as claimed in claim 1, characterized in that the steel is a high alloy steel.

3. Compound body as claimed in claim 1, characterized in that the base element comprises a round or convex surface receiving the heater layer.

4. Compound body as claimed in claim 1, characterized in that the base element is tubular.

5. Compound body as claimed in claim 1, characterized in that the base element is a manifold or material feed tube of a hot duct system.

6. A compound body comprising a steel base element on which is deposited a heater layer, characterized in that the base element is made of a precipitation hardening steel, characterized in that the heater layer is a compound layer consisting of several strata and/or stratum elements and at least one temperature sensor is integrated into the plane of the heater layer.

7. Compound body as claimed in claim 6, characterized in that the heater layer comprises an insulating layer deposited on the base element.

8. Compound body as claimed in claim 7, characterized in that the insulation layer is a ceramic or a glass ceramic.

9. Compound body as claimed in claim 7, characterized in that an array of resistance elements is configured on the insulation layer.

10. A compound body comprising a steel base element on which is deposited a heater layer, characterized in that the base element is made of a precipitation hardening steel, characterized in that the heater layer is a compound layer consisting of several strata and/or stratum elements and comprises an insulating layer deposited on the base element, and that an array of resistance elements is configured on the insulation layer, and the resistance elements are covered at least segment-wise by an insulating top coat.

11. A compound body comprising a steel base element on which is deposited a heater layer. characterized in that the base element is made of a precipitation hardening steel, characterized in that the heater layer comprises an insulating layer deposited on the base element and an array of resistance elements is configured on the insulation layer, wherein the insulating layer, further the resistance elements and/or the top coat are baked dispersions or baked on sheets.

12. A compound body comprising a steel base element on which is deposited a heater layer, characterized in that the base element is made of a precipitation hardening steel, characterized in that the heater layer is a compound layer consisting of several strata and/or stratum elements and terminals for the resistance elements and/or the temperature sensors are integrated into the heater layer.

13. Application of a compound body as claimed in claim 1 as an externally heated material feed tube in a hot duct manifold and/or a hot duct nozzle.

14. A method for manufacturing a compound body comprising a steel base element on which is deposited a heater layer, characterized in that the base element is made of a precipitation hardening steel characterized in that pre-compression generated beforehand in the heater layer is reinforced by precipitation hardening the base element.

15. Method as claimed in claim 14, characterized in that each stratum or each stratum element of the heater layer is deposited on the base element, is dried and baked-on or formed and in that the compound body is cooled to room temperature following each baking procedure.

16. Method as claimed in claim 14, characterized in that the base element's steel alloy is homogenized or solution-annealed during the baking-on process.

17. Method as claimed in claim 14, characterized in that the bake-on temperature equals the temperature at which the base element is homogenized respectively solution annealed.

18. Method as claimed in claim 14, characterized in that the strata or strata elements of the heater layer are deposited using screen printing, or dispensers, by immersion or by spraying.

19. Method as claimed in claim 14, characterized in that each stratum respectively each stratum element is baked-on or formed under atmospheric air.

20. Method as claimed in claim 19, characterized in that the bake-on temperature is between 750 and 900° C.

21. Method as claimed in claim 14, characterized in that the base element's surface is roughened, illustratively by sandblasting, before the heater layer is deposited.

22. Method as claimed in claim 14, characterized in that the base element is cleaned and/or oxidized before the heater layer is deposited.

23. Method as claimed in claim 14, characterized in that the base element's steel alloy is age hardened by annealing after the heating layer has been deposited.

24. Method as claimed in claim 23, characterized in that the temperature of age hardening is lower than the bake-on temperature of the individual heater layer strata.

25. Method as claimed in claim 14, characterized in that age hardening is carried out in an atmosphere of air or nitrogen.

26. Compound body as claimed in claim 10, characterized in that the steel is a high alloy steel.

27. Compound body as claimed in claim 10, characterized in that the base element comprises a round or convex surface receiving the heater layer.

28. Compound body as claimed in claim 10, characterized in that the base element is tubular.

29. Compound body as claimed in claim 10, characterized in that the base element is a manifold or material feed tube of a hot duct system.

30. Compound body as claimed in claim 11, characterized in that the steel is a high alloy steel.

31. Compound body as claimed in claim 11, characterized in that the base element comprises a round or convex surface receiving the heater layer.

32. Compound body as claimed in claim 11, characterized in that the base element is tubular.

33. Compound body as claimed in claim 11, characterized in that the base element is a manifold or material feed tube of a hot duct system.

34. Compound body as claimed in claim 12, characterized in that the heater layer comprises an insulating layer deposited on the base element.

35. Compound body as claimed in claim 34, characterized in that the insulation layer is a ceramic or a glass ceramic.

36. Compound body as claimed in claim 34, characterized in that an array of resistance elements is configured on the insulation layer.

* * * * *